United States Patent [19]

Holman, Jr. et al.

[11] 4,407,775

[45] Oct. 4, 1983

[54] PRESSURELESS CONSOLIDATION OF METALLIC POWDERS

[75] Inventors: James L. Holman, Jr.; John F. McIlwain; L. A. Neumeier, all of Rolla, Mo.

[73] Assignee: The United States of America as represented by the Secretary of the Interior, Washington, D.C.

[21] Appl. No.: 258,076

[22] Filed: Apr. 27, 1981

[51] Int. Cl.[3] ..... B22F 3/10

[52] U.S. Cl. ..... 419/36; 419/39; 419/56

[58] Field of Search ..... 75/200, 202, 224, 225, 75/228, 244; 148/26; 419/9, 36, 39, 56

[56] References Cited

U.S. PATENT DOCUMENTS

| | | | |
|---|---|---|---|
| 2,686,134 | 8/1954 | Wooding | 148/26 |
| 2,700,091 | 1/1955 | Culbertson | 148/26 |
| 3,166,833 | 1/1965 | Globus | 75/244 |
| 3,704,508 | 12/1972 | Giambattista | 29/420.5 |
| 3,971,657 | 7/1976 | Daver | 419/36 |
| 4,227,927 | 10/1980 | Black et al. | 419/60 |

*Primary Examiner*—Brooks H. Hunt
*Assistant Examiner*—Anne Brookes
*Attorney, Agent, or Firm*—William S. Brown

[57] ABSTRACT

Pressureless consolidation of metallic powders is achieved by sintering, in a nonoxidizing atmosphere, a blend of the metallic powder with a small amount of finely divided lithium tetraborate.

5 Claims, No Drawings

PRESSURELESS CONSOLIDATION OF METALLIC POWDERS

This invention relates to a process for pressureless consolidation of metallic powders, such as high-speed steel alloy powders and certain high-alloy ferrous powders, without the need for the complex and costly high pressure compacting or pressing apparatus that are conventionally employed for consolidation of such powders.

The process of the invention involves sintering a noncompacted blend of the metallic powder and finely divided lithium tetraborate or similar metal borate, in an open or nonsealed mold in a nonoxidizing atmosphere. This procedure has been found to generally result in densification of the metallic powders in excess of 90 percent of theoretical density, while retaining roughly the shape but a smaller geometry than the inside dimensions of the mold.

Pressureless densification of metallic powders has been previously disclosed, e.g., in U.S. Pat. No. 3,704,508, in which a dilute solution of boric acid in methanol was employed in densification of nickel-base superalloys or other alloys. The use of lithium tetraborate, $Li_2B_4O_7$, has, however, been found by applicants to be particularly effective in consolidation of ferrous-base alloys, e.g, for formation of high-speed steel products or other iron-base alloys.

As indicated above, the metallic powders employed in the process of the invention preferably consist of ferrous-base alloys, i.e., those containing a major amount of iron and minor amounts of other constituents such as molybdenum, tungsten, chromium, vanadium, manganese, nickel, niobium, carbon, etc. However, the process is also applicable to other alloys which, in common with the ferrous base alloys, have thin oxide coatings or films which prevent intimate metallic surface contact, and thereby impede densification in the absence of the high pressure compaction of conventional processes. Although the function of the metal borate in the process of the invention is not known with certainty, it is believed to react with and disrupt the surface coatings, thereby permitting sintering densification of noncompacted particles into a consolidated mass. Preparation of such alloy powders are well known, and do not constitute an essential aspect of the present invention. Atomized prealloyed powders having particle sizes of 80-mesh or finer have been found to give good results in the process of the invention.

The lithium tetraborate is also employed in finely divided form. However, the particle size is not critical, commercially available material being adequate. Optimum amounts of tetraborate employed in the process of the invention may vary considerably with the particular alloy, temperature, etc., but an amount of about 0.25 to 1 percent by weight of the alloy powder generally gives good results. Blending of the metallic powder and the lithium tetraborate is readily accomplished by conventional means such as ball-milling for a time sufficient to achieve an intimate admixture of the two ingredients.

The blended powder is loaded into an open container or mold for consolidation. Conventional container materials such as ceramic, carbon with ceramic liner, or borosilicate glass may be used. The blend is preferably vibrated into the container to achieve maximum packing density. Tap density of the packed powder should be about 40 percent or greater depending on the specific powder.

The powder is then consolidated by sintering either in an inert gas atmosphere, such as helium, or in a vacuum. Suitable pressures for vacuum sintering are about $10^{-1}$ torr or less. Sintering temperatures must remain below the solidus temperature of the powder to avoid melting of the powder. Final sintering temperatures of about 1200 to 1250° C. have been found to be adequate for the ferrous alloy powders, but higher temperatures below the solidus of the powders can be employed. Best results are generally achieved when the final or highest sintering temperature is within about 100° C. of the solidus temperature of the powder. It is generally desirable to initially heat the powder and container at a lower temperature, e.g., about 650° to 800° C., for a period of about ½-hour in order to help outgas the powders and container before increasing the temperature to the final sintering temperature, although good results can be achieved without such presintering. Suitable sintering times will usually be about 1 hour per inch of initial thickness of the powder charge. Sintered densities of about 90 to 95 percent of theoretical can generally be thus obtained.

The process of the invention assures minimum surface interconnected porosity, which allows for reheating of the sintered shape in air with minimal internal oxidation for any desired subsequent operations such as hot working to complete densification and shaping, or to heat treat the product to enhance properties. The invention also permits forming of irregular shapes not readily formed by conventional compacting. In addition, there are no inherent size limits of the products.

The process of the invention will be more specifically illustrated by the following examples.

EXAMPLE 1

A tool steel powder of 80-mesh particle size or finer, and consisting of 4.9 percent molybdenum, 6.3 percent tungsten, 4 percent chromium, 2 percent vanadium, 0.26 percent manganese, 1 percent carbon, with the balance essentially iron, was consolidated by the process of the invention. The powder was initially blended with 0.5 weight percent lithium tetraborate powder, of about minus 100-mesh particle size, by ball-milling for ½-hour in a jar mill containing agate balls.

Blended powder was loaded into an open ceramic-lined graphite mold, and the mold was vibrated to achieve a tap density of approximately 40 percent. Sintering of the powder was then carried out in a furnace in a helium atmosphere by means of the following procedure: The blend and container were first heated to about 760° C. for ½ hour, and the temperature was then increased to a final sintering temperature of about 1225° C. and held there for a period approximating 1 hour per inch of starting powder thickness. The resulting product was found to have a sintered density of 94 percent of the theoretical density.

EXAMPLE 2

The procedure of this example was similar to that of Example 1, except that the atmosphere was a vacuum of less than $5\times10^{-2}$ torr. The product density was about 92 percent of theoretical.

EXAMPLE 3

In this example, the process of the invention was used to consolidate powder of an iron-base superalloy consisting of about 21 percent chromium, 5 percent each of manganese and nickel, 1 percent each of molybdenum, tungsten, and niobium, 0.5–1 percent carbon, with the balance essentially iron. The powder was blended with 0.5 percent lithium tetraborate, vibrated in a ceramic mold to 60 percent tap density, and sintered at 1235° C. in a vacuum of $5\times10^{-3}$ torr. The resultant density was about 96 percent of theoretical.

We claim:

1. A process for pressureless consolidation of alloy powders, said alloys containing a ferrous alloy, consisting essentially of:

blending the alloy powder with about 0.25 to 1 percent of lithium tetraborate powder; and placing the resulting admixture in an open mold, and heating in a nonoxidizing atmosphere at an elevated temperature that is below the solidus temperature of the powder for a time sufficient to effect substantial consolidation of the powder particles.

2. The process of claim 1 in which the non-oxidizing atmosphere consists of a vacuum or an inert gas.

3. The process of claim 1 in which the elevated temperature is about 1200° to 1250° C.

4. The process of claim 1 in which the elevated temperature is within about 100° C. of the solidus temperature of the powder.

5. The process of claim 1 in which the admixture is heated at a temperature and for a time sufficient to cause a densification of the powder particles of at least about 90 percent of theoretical density.

* * * * *